US007606385B2

(12) United States Patent
Akino

(10) Patent No.: US 7,606,385 B2
(45) Date of Patent: Oct. 20, 2009

(54) UNIDIRECTIONAL DYNAMIC MICROPHONE

(75) Inventor: Hiroshi Akino, Machida (JP)

(73) Assignee: Kabushiki Kaisha Audio-Technica, Machida-shi, Tokyo (JP)

( * ) Notice: Subject to any disclaimer, the term of this patent is extended or adjusted under 35 U.S.C. 154(b) by 596 days.

(21) Appl. No.: 11/081,715

(22) Filed: Mar. 17, 2005

(65) Prior Publication Data

US 2005/0226450 A1 Oct. 13, 2005

(30) Foreign Application Priority Data

Mar. 24, 2004 (JP) ..... 2004-086441

(51) Int. Cl.
*H04R 25/00* (2006.01)

(52) U.S. Cl. ..... 381/361; 381/355; 381/366

(58) Field of Classification Search ..... 381/355, 381/356, 359–362, 368, 122
See application file for complete search history.

(56) References Cited

U.S. PATENT DOCUMENTS 2,848,561 A * 8/1958 Gorike ..... 381/357
3,651,286 A * 3/1972 Gorike et al. ..... 381/353
3,989,905 A * 11/1976 Anderson et al. ..... 381/360
6,091,828 A * 7/2000 Akino et al. ..... 381/355

* cited by examiner

*Primary Examiner*—Suhan Ni
*Assistant Examiner*—Jasmine Pritchard
(74) *Attorney, Agent, or Firm*—Manabu Kanesaka

(57) ABSTRACT

There is provided a unidirectional dynamic microphone provided with an air chamber for a microphone unit in a grip housing thereof, in which even if an external force is applied to the grip housing, the volume of the air chamber does not change, and also the assembling/disassembling of the microphone can be performed easily. In the unidirectional dynamic microphone in which the grip housing 100 formed in a cylindrical shape is provided; on one end side of the grip housing 100, the microphone unit 20 is supported, and on the other end side thereof, an output connector 30 is mounted; and an air chamber 201 included as a part of an audio circuit of the microphone unit 20 is provided in the grip housing 100, a cylindrical cavity sleeve 200 is provided which is supported in the grip housing 100 via shock mount members 210 and 231 exhibiting rubber elasticity and the interior of which is hollow to form the air chamber 201 for the microphone unit 20.

4 Claims, 3 Drawing Sheets

UNIDIRECTIONAL DYNAMIC MICROPHONE

RELATED APPLICATIONS

The present application is based on, and claims priority from, Japanese Application Number 2004-086441, filed Mar. 24, 2004, the disclosure of which is hereby incorporated by reference herein in its entirety.

TECHNICAL FIELD

The present invention relates to a unidirectional dynamic microphone. More particularly, it relates to a configuration of an air chamber in a grip housing, which is included as a part of an audio circuit of a dynamic microphone unit.

BACKGROUND ART

As described in Patent Document 1 (Japanese Patent Application Publication No. H5-49090), one of factors for determining the frequency characteristic of a unidirectional dynamic microphone is an air chamber. In a handheld microphone, for example, for vocal use, the air chamber is usually provided in a grip housing formed in a cylindrical shape. One example of such a microphone is explained with reference to FIG. 5.

In a handheld unidirectional dynamic microphone, a grip housing 10 formed in a cylindrical shape by, for example, die casting is provided, and a microphone unit 20 is supported on one end side thereof. Although not shown, the microphone unit 20 incorporates a diaphragm fitted with a voice coil and a magnetism generating circuit having a magnetic gap, and the voice coil is arranged in the magnetic gap via the diaphragm so as to be capable of vibrating.

Because of being unidirectional, the microphone unit 20 is provided with a front audio terminal 20*a* and a rear audio terminal 20*b*. The microphone unit 20 is attached to one end side of the grip housing 10 via a connecting ring 11 in a state in which the rear end side thereof is airtightly inserted in the connecting ring 11. Between the connecting ring 11 and the grip housing 10, a shock mount member 12 exhibiting rubber elasticity is provided to reduce handling noise. Reference numeral 13 denotes a holding ring.

On the other end side of the grip housing 10 is integrally formed a connector storage portion 14, and an output connector 30 is mounted in the connector storage portion 14. The microphone unit 20 and the output connector 30 are connected to each other by a lead wire, not shown. The interior of the grip housing 10 is hollow, and functions as an air chamber 10*a* for the microphone unit 20.

In order to improve the tone quality in a low register, the volume of the air chamber 10*a* is preferably made large. Anyway, to obtain high directionality, it is necessary to prevent air from intruding into the air chamber 10*a* from the outside. For this purpose, in the conventional example, after the microphone unit 20 and the output connector 30 have been connected to each other by the lead wire, not shown, the output connector side is sealed by a sealing compound 15 such as silicon sealant applied into the grip housing 10.

However, the above-described conventional example has problems as described below. First, if an external force caused by tapping or rubbing is applied to the grip housing 10, the housing is displaced minutely, and accordingly the volume of the air chamber 10*a* in the grip housing 10 changes though minutely, which appears as handling noise.

Next, regarding the workability, the sealing compound is difficult to pour, and also waiting time is required before curing, so that the productivity is low. Also, when the output connector 30 is damaged and replaced, for example, by a drop shock and the like, the sealing compound 15 must be scraped off, which requires much time and labor.

SUMMARY OF THE INVENTION

Accordingly, an object of the present invention is to provide a unidirectional dynamic microphone provided with an air chamber for a microphone unit in a grip housing thereof, in which even if an external force is applied to the grip housing, the volume of the air chamber does not change, and also the assembling/disassembling of the microphone can be performed easily.

To achieve the above object, the present invention provides a unidirectional dynamic microphone in which a grip housing formed in a cylindrical shape is provided; on one end side of the grip housing, a microphone unit is supported, and on the other end side thereof, an output connector connected to the microphone unit via a lead wire is mounted; and an air chamber included as a part of an audio circuit of the microphone unit is provided in the grip housing, characterized in that a cylindrical cavity sleeve is provided which is supported in the grip housing via shock mount members exhibiting rubber elasticity and the interior of which is hollow to form the air chamber.

According to this configuration, since the air chamber is provided in the cavity sleeve supported in the grip housing via the shock mount members, even if an external force caused by tapping or rubbing is applied to the grip housing, the volume of the air chamber does not change. Therefore, handling noise is reduced. Also, since the performance can be measured at a stage before the cavity sleeve is assembled into the grip housing, namely, in the state of subassembly, defectives in final assembly can be reduced.

As a preferable mode, a rear end part of the microphone unit is fitted on one end side of the cavity sleeve, and on the other end side of the cavity sleeve is airtightly installed a connector support cover for the output connector; and the connector support cover is formed by a rubber elastic body to be also used as one of the shock mount members. According to this configuration, since the connector support cover can be used as the shock mount member, the number of components can be reduced.

Also, it is preferable that the connector support cover should be formed with a pin insertion hole, and a terminal pin of the output connector should be airtightly inserted through the pin insertion hole. According to this configuration, since a sealing compound such as silicon sealant is not needed, the assembling/disassembling work can be performed easily.

DETAILED DESCRIPTION

Figure 1:
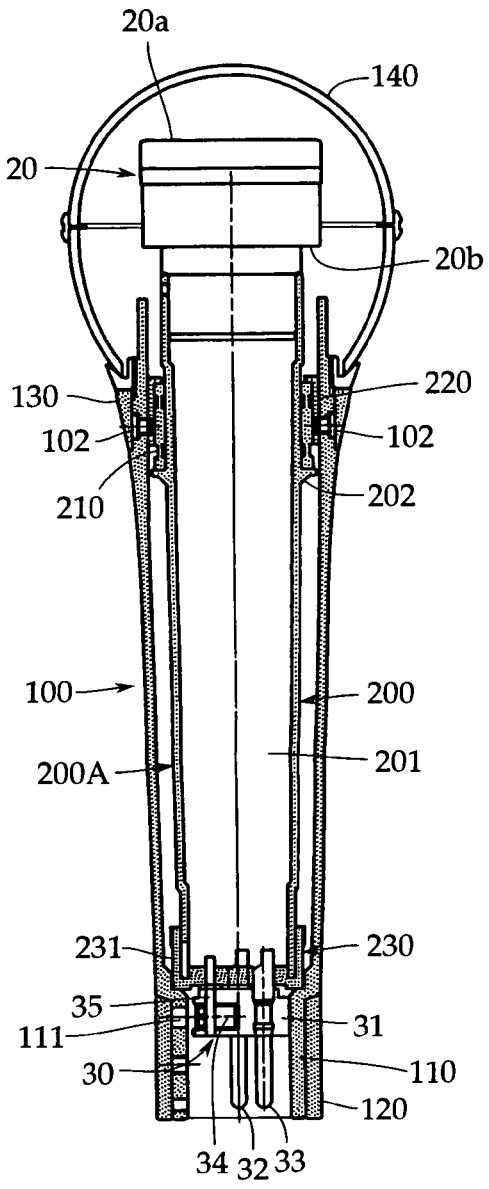
FIG. 1 is a sectional view showing an internal construction of a unidirectional dynamic microphone in accordance with the present invention.
Figure 2:
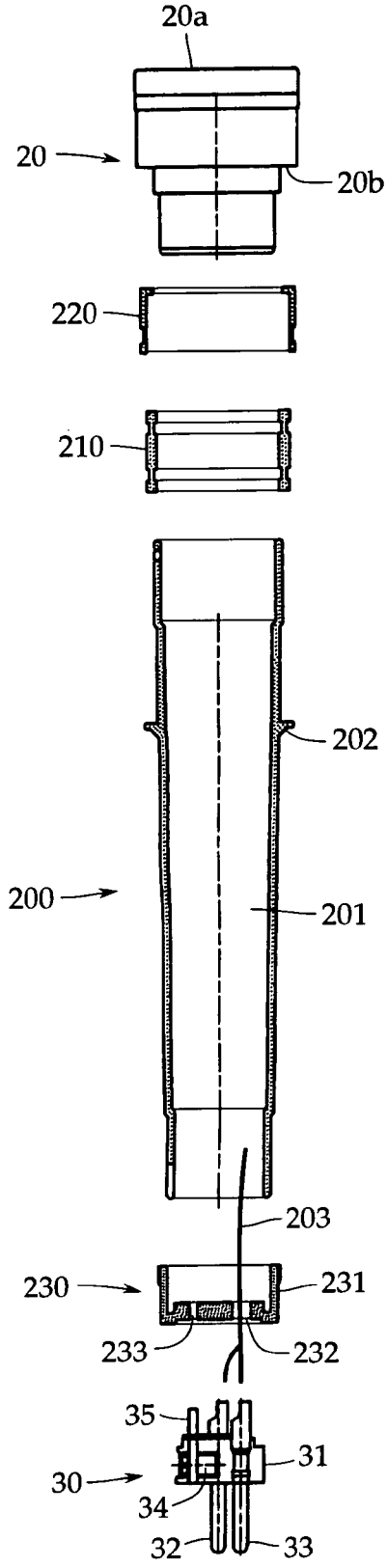
FIG. 2 is an exploded sectional view for illustrating components of the microphone shown in FIG. 1 in the assembly sequence.
Figure 3:
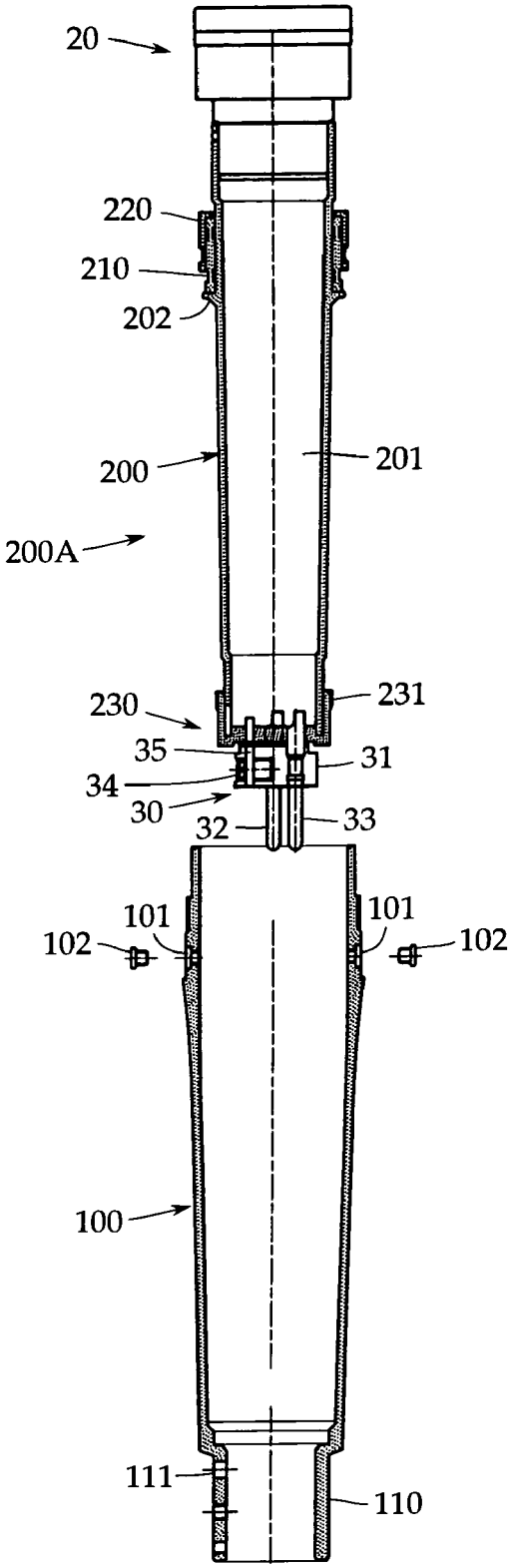
FIG. 3 is an exploded sectional view for illustrating components of the microphone shown in FIG. 1 in the assembly sequence.
Figure 4:
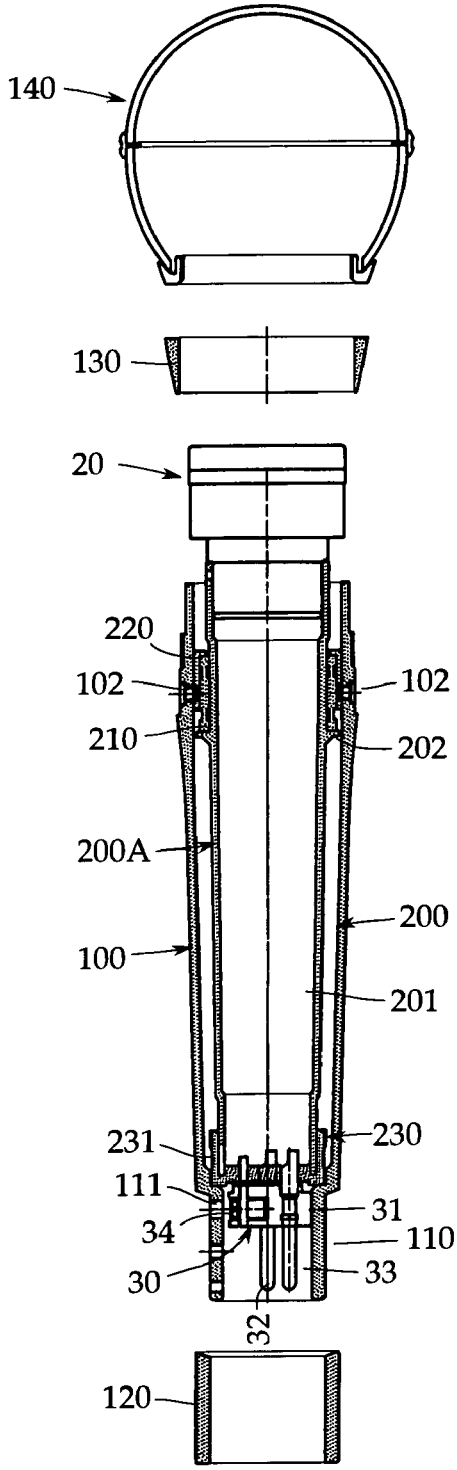
FIG. 4 is an exploded sectional view for illustrating components of the microphone shown in FIG. 1 in the assembly sequence.

An embodiment of the present invention will now be described with reference to FIGS. 1 to 4. The present invention is not limited to this embodiment. FIG. 1 is a sectional view of a unidirectional dynamic microphone in accordance with the present invention, and FIGS. 2 to 4 are exploded sectional views showing an assembling procedure.

Figure 5:
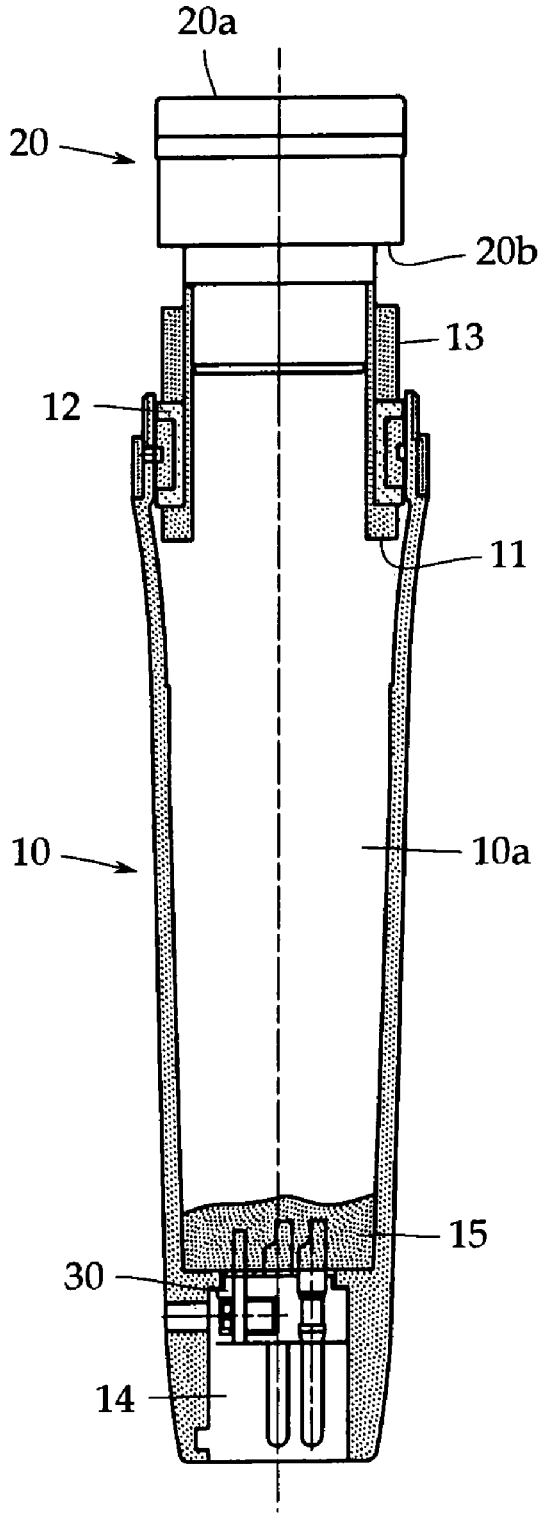
PRIOR ART FIG. 5
FIG. 5 is a sectional view showing an internal construction of a conventional unidirectional dynamic microphone.

First, referring to FIG. 1, the unidirectional dynamic microphone in accordance with the present invention includes a grip housing 100, a cavity sleeve 200, a microphone unit 20, and an output connector 30. The microphone unit 20 and the output connector 30 may be the same as those used in the conventional example explained before with reference to FIG. 5.

Specifically, because of being unidirectional, the microphone unit 20 is provided with a front audio terminal 20*a* and a rear audio terminal 20*b*. Also, although not shown, because of being of a dynamic type, the microphone unit 20 incorporates a diaphragm fitted with a voice coil and a magnetism generating circuit having a magnetic gap, and the voice coil is arranged in the magnetic gap via the diaphragm so as to be capable of vibrating.

As the output connector 30, a connector specified in EIAJ RC-5236 "Circular connectors, latch lock type for audio equipment" is used. Specifically, as the output connector 30, there can be used a three-pin type connector in which three pins of No. 1 pin (omitted in the figure for the reason of drawing) for earthing, No. 2 pin 32 used as the hot side of signal, and No. 3 pin 33 used as the cold side of signal are penetratingly provided in a columnar base 31 formed of an electrical insulating material.

The connector 30 is provided with, in addition to the three pins, an earth terminal strip 35 having a male screw 34 capable of going in and out in the radial direction of the base 31 and an internal thread hole for the male screw 34. The earth terminal strip 35 is electrically conducted to the aforementioned No. 1 pin for earthing by a connecting element and the like, not shown.

Next, the construction of each component will be explained in the assembly sequence with reference to FIGS. 2 to 4. First, referring to FIG. 2, the microphone unit 20 and the output connector 30 are installed in the cavity sleeve 200. The cavity sleeve 200 is preferably made by die casting and formed in a cylindrical shape, and the hollow interior thereof is used as an air chamber 201 included as a part of an audio circuit of the microphone unit 20. The cavity sleeve 200 may be made of a synthetic resin.

The microphone unit 20 is supported by the cavity sleeve 200 by inserting the rear end part thereof into one end side (front end side) of the cavity sleeve 200. Also, a front shock mount member 210 consisting of a rubber elastic body formed in a cylindrical shape is fitted at the outer periphery on one end side of the cavity sleeve 200, and further a holding ring 220 formed of, for example, a copper alloy is put on the front shock mount member 210. On the outer peripheral surface of the cavity sleeve 200, a collar 202 is formed to position the front shock mount member 210.

On the other end side (rear end side) of the cavity sleeve 200 is put a connector support cover 230, and the output connector 30 is installed in the connector support cover 230. The connector support cover 230 is formed by a rubber elastic body, and the skirt part 231 thereof is put so as to cover the outer periphery of the cavity sleeve 200. Therefore, the skirt part 231 of the connector support cover 230 also functions as a rear shock mount member.

The connector support cover 230 is formed with pin insertion holes 232 through which the No. 1 pin for earthing, not shown, and the No. 2 and No. 3 signal pins 32 and 33 on the hot and cold sides are inserted and a terminal strip insertion hole 233 through which the earth terminal strip 35 is inserted, these pins and the earth terminal strip being provided in the output connector 30. Although only one pin insertion hole 232 is shown in the figure, actually a total of three pin insertion holes 232 are formed.

In this case, it is preferable that in order to prevent air from intruding into the air chamber 201 from the rear end side of the cavity sleeve 200, the pin insertion holes 232 and the terminal strip insertion hole 233 be formed so as to be small, and the not illustrated No. 1 pin, the No. 2 and No. 3 pins 32 and 33, and the earth terminal strip 35 be pushed in these holes forcedly and be fitted airtightly. According to this configuration, a sealing compound such as silicon sealant is not needed. However, in some cases, the sealing compound may also be used.

In the actual assembling work, after the microphone unit 20 and the output connector 30 have been connected to each other in advance by a lead wire 203 leading through the cavity sleeve 200, the microphone unit 20 and the output connector 30 are installed in the cavity sleeve 200 as described above. Thereby, a state of a subassembly 200A shown in FIG. 3 is reached.

In this state of the subassembly 200A, since the air chamber 201 in the cavity sleeve 200 is substantially enclosed, the performance as a unidirectional dynamic microphone can be measured at this stage. Therefore, a defective product can be repaired or disposed of before the final assembly.

After the performance measurement, the subassembly 200A is inserted in the grip housing 100 and is screwed. For screwing, the grip housing 100 is provided with several internal thread holes 101 at positions facing to the holding ring 220. Male screws 102 are threadedly engaged with the internal thread holes 101 to tighten the holding ring 220, and thereby the subassembly 200A is fixed in the grip housing 100 as shown in FIG. 4.

The grip housing 100 is a cylindrical body a size larger than the subassembly 200A, and a connector storage portion 110 is integrally provided on the rear end side of the grip housing 100. It is preferable that the grip housing 100 be formed by die casting, and have conductivity.

The connector storage portion 110 is formed with a through hole 111 at a position facing to the male screw 34 of the output connector 30. The male screw 34 is turned by inserting a screwdriver, not shown, through the through hole 111 to project the male screw 34 from the base 31 and bring it into contact with the inner surface of the connector storage portion 110, by which the grip housing 100 and the earth terminal strip 35 are connected electrically to each other.

Thereafter, a sleeve-shaped tale cover 120 formed of a rubber material is put at the outer periphery of the connector storage portion 110. Also, after a name ring 130 has been fitted on the front end side of the grip housing 100, a head case 140 formed of, for example, a mesh metal is put to protect the microphone unit 20.

Thus, the unidirectional dynamic microphone shown in FIG. 1 is finally assembled. In the present invention, the subassembly 200A is coaxially supported via the front shock mount 210 and the rear shock mount member 231 consisting of the skirt part of the connector support cover 230 in the grip housing 100.

Therefore, even if an external force caused by tapping or rubbing is applied to the grip housing 100, the external force is damped by the shock mount members 210 and 231, and the volume of the air chamber 201 in the cavity sleeve 200 does not also change, so that handling noise is reduced significantly.

Also, even if the output connector 30 is damaged by a drop shock etc., the output connector 30 can be disassembled easily because there is no sealing compound such as silicon sealant for sealing the air chamber like the conventional example explained before with reference to FIG. 5.

The invention claimed is:

1. A unidirectional dynamic microphone, comprising:

a grip housing having a cylindrical shape, a cylindrical cavity sleeve forming an air chamber disposed in the grip housing as a part of an audio circuit, a front shock mount member exhibiting rubber elasticity and disposed between the cavity sleeve and the grip housing to elastically hold the cavity sleeve at a front side thereof, a microphone unit having a rear end part fitted on one side of the cavity sleeve, a connector support cover formed of a rubber elastic body and airtightly installed on a rear side of the cavity sleeve, said connector support cover having a skirt part covering a rear outer periphery of the cavity sleeve as a rear shock mount member and disposed between the cavity sleeve and the grip housing to directly contact thereto, and at least one pin insertion hole therein, and an output connector having at least one terminal pin airtightly inserted into the at least one pin insertion hole, said output connector being held inside the grip housing.

2. A unidirectional dynamic microphone according to claim 1, wherein said output connector includes a columnar base for holding the at least one terminal pin, said columnar base contacting the connector support cover and supported by the grip housing.

3. A unidirectional dynamic microphone according to claim 2, further comprising a lead wire connected between the microphone unit and the output connector.

4. A unidirectional dynamic microphone according to claim 1, wherein the connector support cover and the skirt part are integrally formed together as one structure.

* * * * *